US007420452B1

(12) United States Patent
Lee et al.

(10) Patent No.: US 7,420,452 B1
(45) Date of Patent: Sep. 2, 2008

(54) INDUCTOR STRUCTURE

(75) Inventors: Sheng-Yuan Lee, Taipei Hsien (TW); Hsiao-Chu Lin, Taipei Hsien (TW)

(73) Assignee: VIA Technologies, Inc., Taipei Hsien (TW)

( * ) Notice: Subject to any disclaimer, the term of this patent is extended or adjusted under 35 U.S.C. 154(b) by 0 days.

(21) Appl. No.: 11/860,766

(22) Filed: Sep. 25, 2007

(30) Foreign Application Priority Data

Jul. 13, 2007 (TW) ..... 96125621

(51) Int. Cl.
*H01F 5/00* (2006.01)

(52) U.S. Cl. ..... 336/200

(58) Field of Classification Search ..... 336/65, 336/83, 200, 232; 257/531
See application file for complete search history.

(56) References Cited

U.S. PATENT DOCUMENTS 4,816,784 A * 3/1989 Rabjohn ..... 333/24 R
4,992,769 A * 2/1991 Oppelt ..... 336/180
6,927,664 B2 * 8/2005 Nakatani et al. ..... 336/200
6,967,555 B2 * 11/2005 Yu et al. ..... 336/200
7,064,411 B2 6/2006 Hashizume et al.
7,312,683 B1 * 12/2007 Lee ..... 336/200
2005/0077992 A1 * 4/2005 Raghavan et al. ..... 336/200

* cited by examiner

*Primary Examiner*—Tuyen T. Nguyen
(74) *Attorney, Agent, or Firm*—J.C. Patents

(57) ABSTRACT

An inductor structure disposed over a substrate includes a first spiral coil, a second spiral coil and at least a gain pattern. The first spiral coil includes first conducting wires and first connection leads, wherein each first connection lead connects two adjacent first conducting wires. The second spiral coil includes second conducting wires and second connection leads, wherein each second connection lead connects two adjacent second conducting wires. The second spiral coil and the first spiral coil are symmetrically disposed about a plane of symmetry and in series connection to form a spiral coil structure with 2N turns, wherein N is a positive integral, and are spaced from the substrate by different heights to form 2N−1 interlaced zones. The gain pattern is disposed under the first connection lead at the $(2N-1)^{th}$ interlaced zone counted from the most-outer turn up and electrically connected to the corresponding first connection lead.

18 Claims, 6 Drawing Sheets

INDUCTOR STRUCTURE

CROSS-REFERENCE TO RELATED APPLICATION

This application claims the priority benefit of Taiwan application serial no. 96125621, filed on Jul. 13, 2007. All disclosure of the Taiwan application is incorporated herein by reference.

BACKGROUND OF THE INVENTION

1. Field of the Invention

The present invention generally relates to an inductor structure, and more particularly, to an inductor structure capable of improving Q-factor (quality factor).

2. Description of Related Art

In general speaking, as an inductor acquires energy storing and releasing functions through electromagnetic conversion, the inductor can be used as an element for stabilizing current. An inductor is broadly applicable in many fields, such as in radio frequency circuit (RF circuit), voltage-controlled oscillator (VCO), low noise amplifier (LNA) or power amplifier (PA). In an integrated circuit (IC), an inductor plays a very important and extreme challenging role and serves as a passive component. In terms of the efficiency thereof, an inductor with higher quality means the inductor has a higher quality factor represented by Q-factor, which is defined by:

$$Q=\omega\times L/R$$

where ω is angular frequency, L is inductance of the inductor coil and R is resistance considering inductance loss under specific frequencies.

There are various methods and techniques today available for incorporating an inductor with IC process. However, in an IC, the limitation of the metal thickness of an inductor and the interference on an inductor by a silicon substrate would degrade the quality of the inductor. To overcome the problem in the prior art, the conductor loss is reduced by increasing the metal thickness of an inductor or the wire width of the inductor coil so as to advance the Q-factor of inductor. When the above-mentioned conventional scheme is used in a symmetric differential inductor, in particular, along with increasing the wire width of the inductor coil, a coupling in certain extents between the two coils of the inductor and the substrate occurs, which affects the efficiency of the inductor.

In short, how to solve the various problems encountered in the above-mentioned process, advance Q-factor of an inductor and reduce conductor loss has become an important project for the manufactures to develop.

SUMMARY OF THE INVENTION

Accordingly, the present invention is directed to an inductor structure capable of improving conductor loss of inductor and advancing the inductor quality.

The present invention provides an inductor structure disposed over a substrate. The inductor structure includes a first spiral coil, a second spiral coil and at least a gain pattern. The first spiral coil has a first end and a second end, wherein the second end rotates in spiral fashion towards the inner portion of the first spiral coil. The first spiral coil includes a plurality of first conducting wires and a first connection lead connecting each two adjacent first conducting wires. The second spiral coil and the first spiral coil are symmetrically disposed about a plane of symmetry. The second spiral coil has a third end and a fourth end, wherein the fourth end rotates in spiral fashion towards the inner portion of the second spiral coil and connects the second end of the first spiral coil so as to form a spiral coil structure with 2N turns, wherein N is a positive integral. The second spiral coil includes a plurality of second conducting wires and a second connection lead connecting each two adjacent second conducting wires. The first connection lead is interlaced with the second connection lead on the plane of symmetry, and both connection leads are spaced from the substrate by different heights so as to form 2N−1 interlaced zones. The gain pattern is disposed under the first connection lead at the $(2N-1)^{th}$ interlaced zone counted from the most-outer turn up and electrically connected to the corresponding first connection lead.

The present invention also provides an inductor structure disposed over a substrate. The inductor structure includes a first spiral coil, a second spiral coil and at least a gain pattern. The first spiral coil has a first end and a second end, wherein the second end rotates in spiral fashion towards the inner portion of the first spiral coil. The first spiral coil includes a plurality of first conducting wires and a first connection lead connecting each two adjacent first conducting wires. The second spiral coil and the first spiral coil are symmetrically disposed about a plane of symmetry. The second spiral coil has a third end and a fourth end, wherein the fourth end rotates in spiral fashion towards the inner portion of the second spiral coil and connects the second end of the first spiral coil so as to form a spiral coil structure with 2N+1 turns, wherein N is a positive integral. The second spiral coil includes a plurality of second conducting wires and a second connection lead connecting each two adjacent second conducting wires. The first connection lead is interlaced with the second connection lead on the plane of symmetry, and both connection leads are spaced from the substrate by different heights so as to form 2N interlaced zones. The gain pattern is disposed under the second connection lead at the $2N^{th}$ interlaced zone counted from the most-outer turn up and electrically connected to the corresponding second connection lead.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
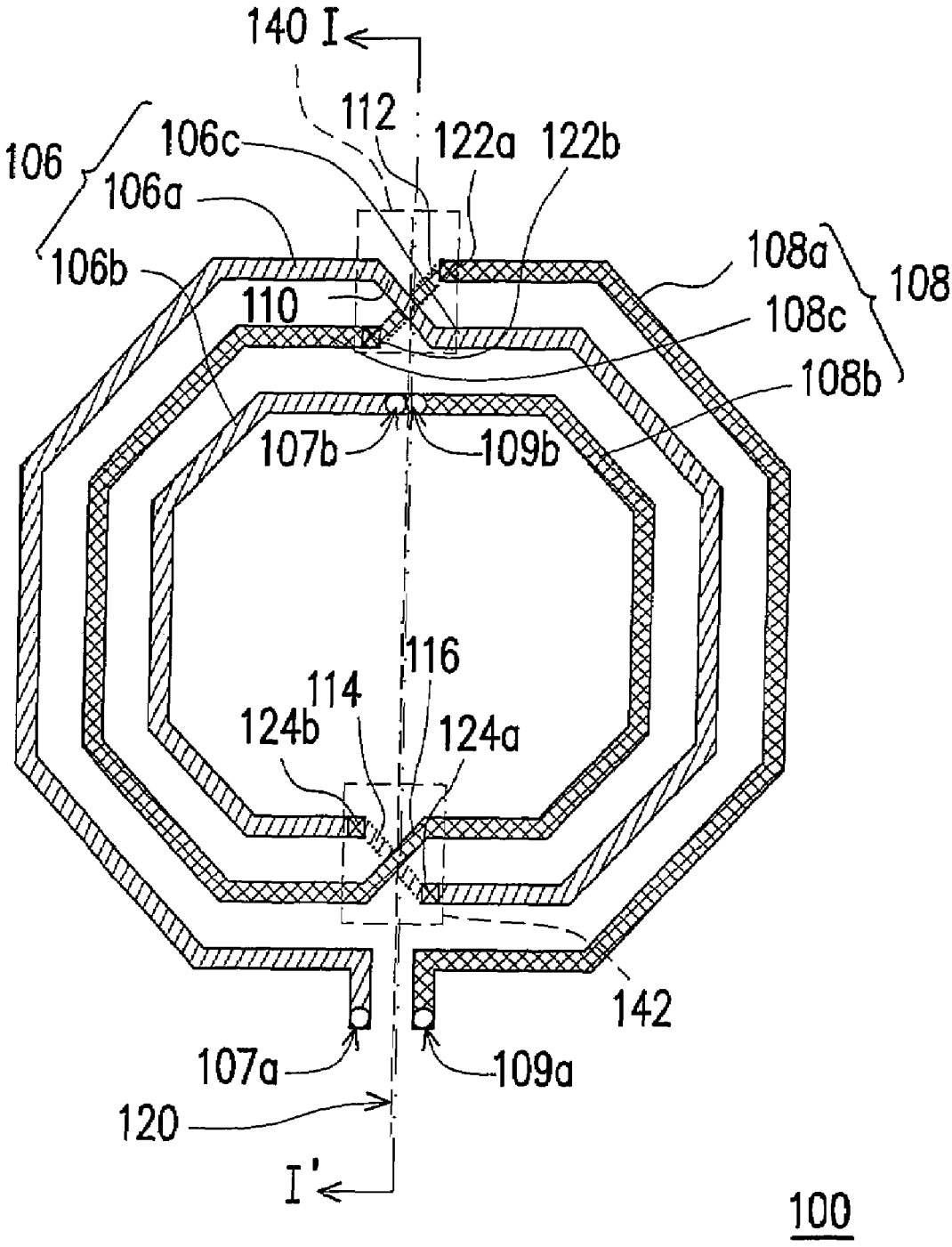
FIG. 1A is a top view diagram of an inductor structure according to an embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

Figure 1B:
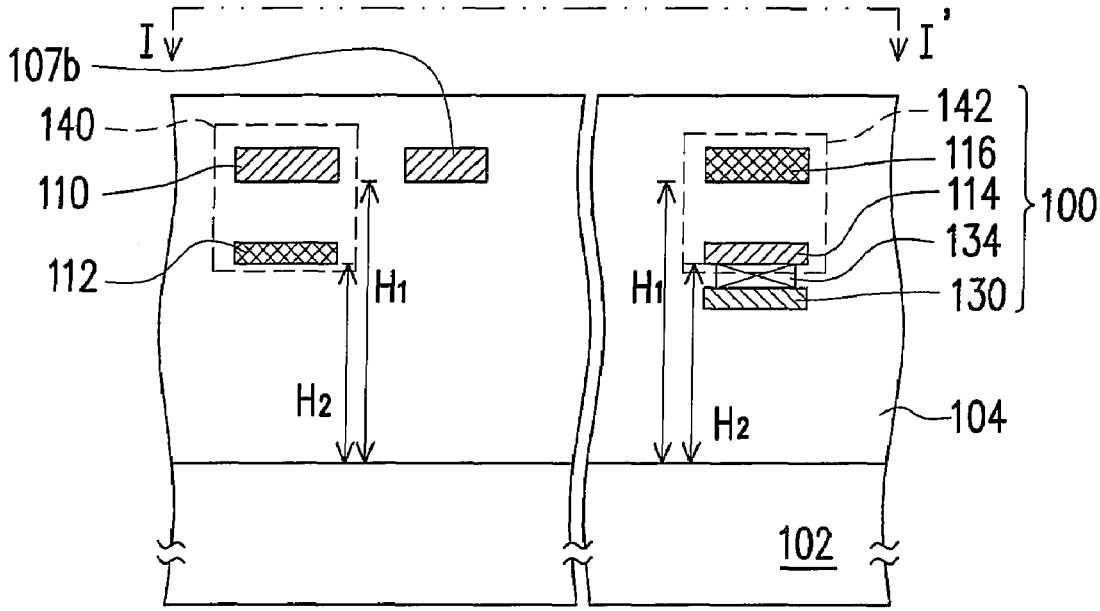
FIG. 1B is a cross-sectional diagram taken across I-I' line in FIG. 1A.
Figure 1C:
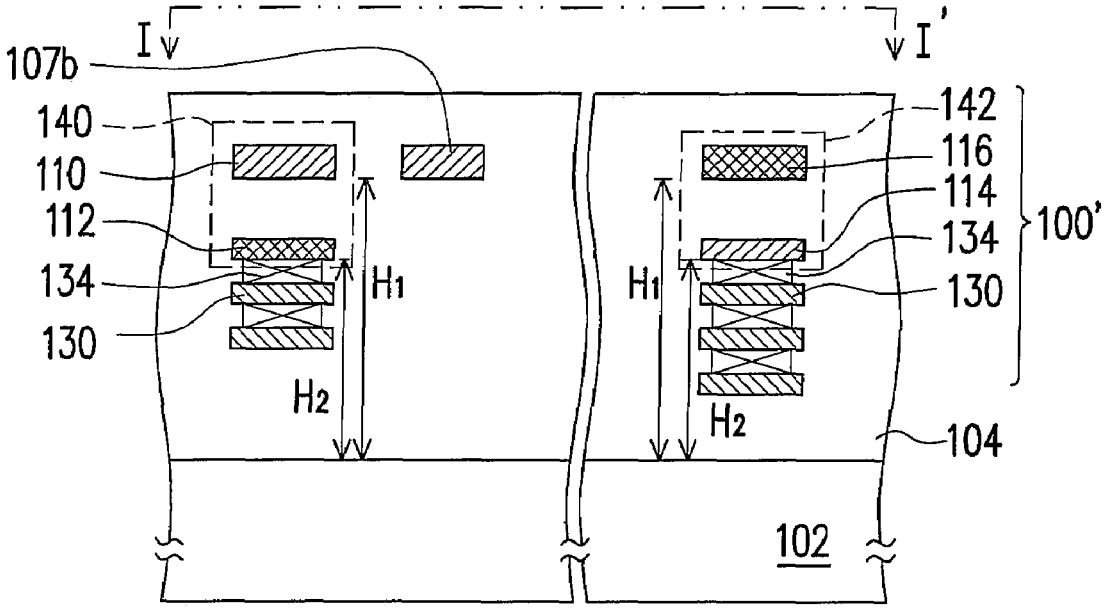
FIG. 1C is a cross-sectional diagram taken across I-I' line in FIG. 1A according to another embodiment of the present invention.

FIG. 1A is a top view diagram of an inductor structure according to an embodiment of the present invention, FIG. 1B is a cross-sectional diagram taken across I-I' line in FIG. 1A and FIG. 1C is a cross-sectional diagram taken across I-I' line in FIG. 1A according to another embodiment of the present invention.

Referring to FIGS. 1A and 1B, an inductor structure 100 is, for example, disposed in a dielectric layer 104 located on a substrate 102. The inductor structure 100 includes a spiral coil 106, a spiral coil 108 and at least a gain pattern 130, wherein the inductor structure 100 may be fabricated by a semiconductor process. The substrate 102 is, for example, a silicon substrate. The material of the dielectric layer 104 is, for example, silicon oxide or other dielectric materials. The material of the spiral coils 106 and 108 may be metal, for example, copper or aluminum copper alloy etc. The material of the gain pattern 130 may be metal, for example, copper or aluminum copper alloy etc.

The spiral coil 106 and the spiral coil 108 are, for example, symmetrically disposed about a plane of symmetry 120, wherein the plane of symmetry 120 extends, for example, towards the page. The spiral coil 106 and the spiral coil 108 are, for example, intertwisted to each other to form a spiral coil structure with 2N+1 turns and having 2N interlaced zones, wherein N is a positive integral.

In more detail, the spiral coil 106 has an endpoint 107*a* and another endpoint 107*b*, wherein the endpoint 107*a* is disposed at the outer portion of the spiral coil 106, while the endpoint 107*b* rotates in spiral fashion towards the inner portion of the spiral coil 106. The spiral coil 108 has an endpoint 109*a* and another endpoint 109*b*, wherein the endpoint 109*a* is disposed symmetrically to the endpoint 107*a* and at the outer portion of the spiral coil 108, while the endpoint 109*b* is disposed symmetrically to the endpoint 107*b* and rotates in spiral fashion towards the inner portion of the spiral coil 108, and the endpoints 107*b* and 109*b* are connected to each other on the plane of symmetry 120. In other words, the spiral coil 106 and the spiral coil 108 are intersected and connected to each other at the most-inner turn of the symmetric spiral coil structure (the $(2N+1)^{th}$ turn counted from the most-outer turn).

In addition, the spiral coil 108 includes a plurality of first conducting wires and a plurality of first connection leads, wherein each of the first connection leads is for connecting two adjacent first conducting wires. The spiral coil 106 includes a plurality of second conducting wires and a plurality of second connection leads, wherein each of the second connection leads is for connecting two adjacent first conducting wires. The interlaced zones of the first connection leads and the second connection leads are located on the plane of symmetry 120. The first connection leads and the second connection leads are, for example, spaced from the substrate 102 by different heights so as to avoid intercontact thereof. That is to say, if an interlaced zone is an $odd^{th}$ interlaced zone counted from the most-outer turn up, the first connection lead would be underlying the second connection lead; if an interlaced zone is an $even^{th}$ interlaced zone counted from the most-outer turn up, the second connection lead would be underlying the first connection lead.

In the following, an example taking N=1 is described, where an inductor structure 100 is, for example, a 3-turns structure having two interlaced zones.

As shown by FIG. 1A, a spiral coil 106 is, for example, composed of second conducting wires 106*a*, 106*b* and 106*c* and second connection leads 110 and 114, wherein the second conducting wires 106*a*, 106*c* and 106*b* are connected in series to each other by the second connection leads 110 and 114. A spiral coil 108 is, for example, composed of first conducting wires 108*a*, 108*b* and 108*c* and first connection leads 112 and 116, wherein the first conducting wires 108*a*, 108*c* and 108*b* are connected in series to each other by the first connection leads 112 and 116.

Referring to FIGS. 1A and 1B, the interlaced zone 140 of the second connection lead 110 and the first connection lead 112 and the interlaced zone 142 of the second connection lead 114 and the first connection lead 116 are, for example, located on the plane of symmetry 120. The interlaced zone 140 is, for example, located at the first interlaced zone of the inductor structure 100 counted from the most-outer turn up, the interlaced zone 142 is, for example, located at the second interlaced zone of the inductor structure 100 counted from the most-outer turn up. The spiral coils 106 and 108 do not contact each other at the interlaced zones 140 and 142 to avoid short circuit when applying an operation voltage. The way for the spiral coils 106 and 108 not to contact each other is, for example, to make the first connection lead 112 underlying the second connection lead 110, and the second connection lead 114 underlying the first connection lead 116.

For example, the second connection lead 110 and the first connection lead 116 are spaced from the surface of the substrate 102 by a height $H_1$, while the second connection lead 114 and the first connection lead 112 are spaced from the surface of the substrate 102 by a height $H_2$, wherein the height $H_1$ is greater that the height $H_2$.

Thus at the interlaced zone 140, the second conducting wires 106*a* and 106*c* are connected to each other through, for example, the second connection lead 110 located at the height $H_1$. On the other hand, the first conducting wire 108*a* is connected to the first connection lead 112 located at the height $H_2$ through, for example, a via plug 122*a*, and then the first connection lead 112 is connected to the first conducting wire 108*c* through a via plug 122*b*, so that at the interlaced zone 140 the first connection lead 112 is able to be underlying the second connection lead 110 to avoid the intercontact between the spiral coil 106 and the spiral coil 108.

Similarly, at the interlaced zone 142, the first conducting wires 108*c* and 108*b* are connected to each other through, for example, the first connection lead 116 located at the height $H_1$. As to the wiring relationship between the second conducting wires 106*c* and 106*b*, the second conducting wire 106*c* is connected to the second connection lead 114 located at the height $H_2$ through, for example, a via plug 124*a*, and then the second connection lead 114 is connected to the second conducting wire 106*b* through a via plug 124*b*, so that at the interlaced zone 142 the second connection lead 114 is able to be underlying the first connection lead 116.

Based on the above-described embodiment, when the inductor structure 100 is a spiral coil structure with 2N+1 turns, the gain pattern 130 would be disposed under at least the second connection lead at the $2N^{th}$ interlaced zone counted from the most-outer turn up (i.e., the connection lead over the interlaced zone of the most-inner turn) and electrically connected to the corresponding second connection lead, which contributes to increase the cross-section area of the conductor of the inductor structure 100 and lower the conductor loss. In addition, the gain pattern 130 may be disposed at at least one of the interlaced zones from the first one to the $(2N-1)^{th}$ one and the gain pattern 130 is disposed under the lowest connection lead within the above-mentioned interlaced zone and coupled with the connection lead.

In the following, the inductor structure 100 with three turns and having two interlaced zones (i.e., N=1) is further explained.

Referring to FIGS. 1A and 1B, the gain pattern 130 is disposed, for example, under the second connection lead 114 at the second interlaced zone (the interlaced zone 142) counted from the most-outer turn up. In the embodiment, the gain pattern 130 with one layer is disposed under the second connection lead 114. The gain pattern 130 is coupled with the second connection lead 114 in, for example, parallel connection mode. That is, for example, at least two via plugs 134 are disposed between the second connection lead 114 and the gain pattern 130, so that both terminals of the gain pattern 130 are respectively electrically connected to both terminals of the second connection lead 114.

Referring to FIG. 1C, in an inductor structure 100', except for being disposed under the second connection lead 114, the gain pattern 130 may be also disposed under the first connection lead 112 at the first interlaced zone (the interlaced zone 140) counted from the most-outer turn up. In the embodiment, the gain pattern 130 located at the interlaced zone 140 is, for example, coupled with the first connection lead 112, the gain pattern 130 located at the interlaced zone 142 is, for example, coupled with the second connection lead 114 and the above-mentioned couplings are, for example, parallel connections. Thus, for example, at least two via plugs 134 are disposed between the first connection lead 112 and the gain pattern 130 so as to respectively electrically connect both terminals of the gain pattern 130 to both terminals of the first connection lead 112; for example, at least two via plugs 134 are disposed between the second connection lead 114 and the gain pattern 130 so as to respectively electrically connect both terminals of the gain pattern 130 to both terminals of the second connection lead 114

Continuing to FIG. 1C, the layer numbers of the two gain patterns 130 respectively disposed at the interlaced zone 140 and the interlaced zone 142 are, for example, gradually descending from the most-inner turn to the most-outer turn and disposed in unsymmetrical manner. In more detail, the stack number of the gain pattern 130 under the second connection lead 114 disposed at the $2N^{th}$ interlaced zone (i.e. the second interlaced zone 142 in the embodiment) is greater than the stack number of the gain pattern 130 under the first connection lead 112 disposed at other interlaced zones (i.e. the first interlaced zone 140 in the embodiment). In the inductor structure 100' of the embodiment, the stack number of the gain pattern 130 under the first connection lead 112 is two, while the stack number of the gain pattern 130 under the second connection lead 114 is three. When the gain pattern 130 has a plurality of layers, any two adjacent gain patterns 130 are in parallel connection by means of a plurality of via plugs 134.

In addition, when N=2, the inductor structure is a spiral coil structure with five turns and having four interlaced zones. In an embodiment, the gain pattern is, for example, disposed only under the connection lead at the fourth interlaced zone counted from the most-outer turn up. In another embodiment, except for being disposed under the connection lead at the fourth interlaced zone, the gain pattern is also disposed under the connection lead at one of the three interlaced zones from the first one to the third one, wherein the stack layer number of the gain pattern disposed at the fourth interlaced zone is greater than the stack layer number of the gain pattern at one of the three interlaced zones from the first one to the third one. In yet another embodiment, a gain pattern is disposed at the connection lead at every interlaced zone, the stack layer number at the fourth interlaced zone is the most among all the gain patterns and the stack layer numbers of the gain patterns at other interlaced zones (the first interlaced zone to the third interlaced zone) are, for example, the same or gradually descending from the most-inner turn to the most-outer turn.

In particular, when the above-mentioned inductor structures 100 and 100' are used in a symmetric differential inductor, operation voltages would be applied simultaneously at the endpoints 107*a* and 109*a*. The operation voltage applied at the endpoints 107*a* and the operation voltage applied at the endpoints 109*a* have for example, the same absolute level but opposite polarities. Therefore, in the spiral coil structure composed of the spiral coil 106 and the spiral coil 108, more close to the inner portion of the coil structure, the more descending the absolute level of the voltage is. The voltage at the intersection and connection of the endpoints 107*a* and 109*a* would be zero, which means a virtual grounding situation.

Accordingly, the electric field at the interlaced zone 140 of the outer portion of the inductor structure 100 or 100' is greater than the electric field at the interlaced zone 142 of the inner portion of the inductor structure 100 or 100'. At the interlaced zone 140 with greater electric field, there is a greater coupling between the connection lead 112 and the substrate 102 to cause increasing parasitic capacitance. On the other hand, due to a larger current density at the interlaced zone 142, the conductor loss of the second connection lead 114 at the inner interlaced zone 142 needs to pay more attention. As shown by FIGS. 1B and 1C, deploying a stacked gain pattern 130 under the interlaced zone 142 contributes to increase the cross-section area of the conductor of the second connection lead 114 to effectively improve the conductor loss. In addition, if the stack layer number of the gain pattern 130 disposed under the interlaced zone 140 is less than that of the gain pattern 130 under the interlaced zone 142 (as shown by FIGS. 1B and 1C), excessive parasitic capacitance caused by the first connection lead 112 and the substrate 102 can be avoided. Thus, along with improving conductor loss, the coupling between the first connection lead 112 and the substrate 102 would be approximately equal to the coupling between the second connection lead 114 and he substrate 102, which makes the spiral coil 106 and the spiral coil 108 respectively have a more symmetric response to each other.

Figure 2A:
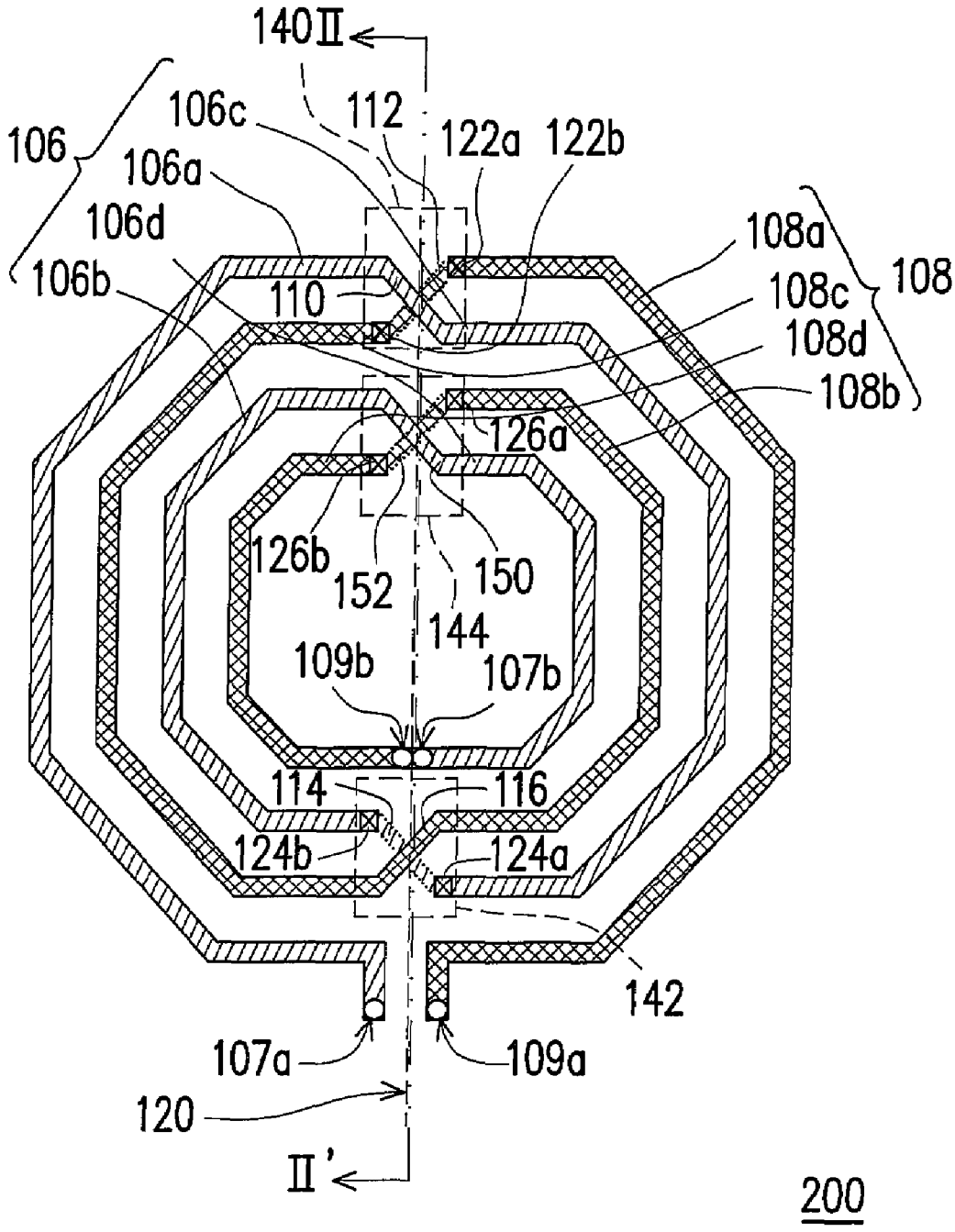
FIG. 2A is a top view diagram of an inductor structure according to yet another embodiment of the present invention.
Figure 2B:
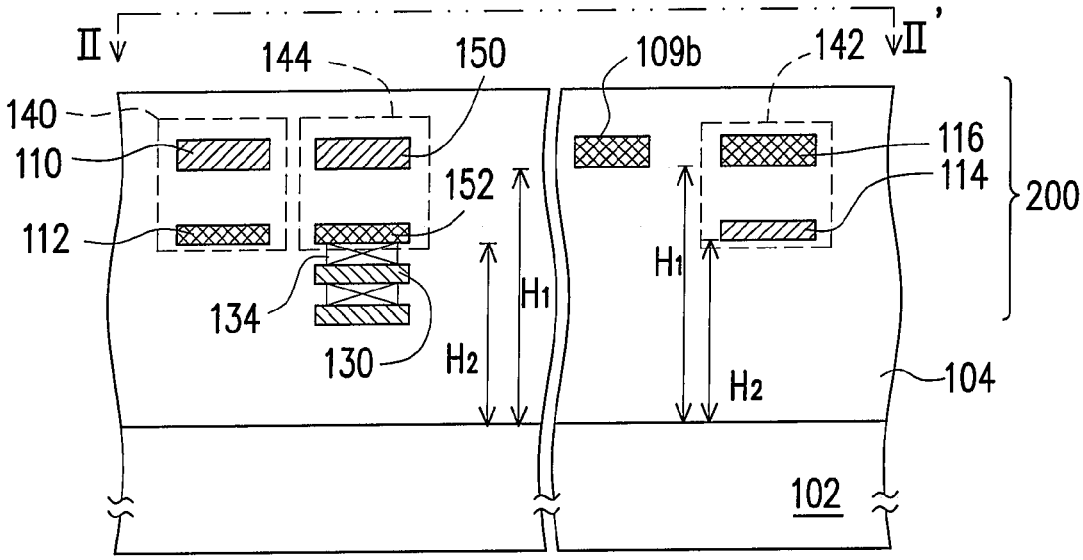
FIG. 2B is a cross-sectional diagram taken across II-II' line in FIG. 2A.
Figure 2C:
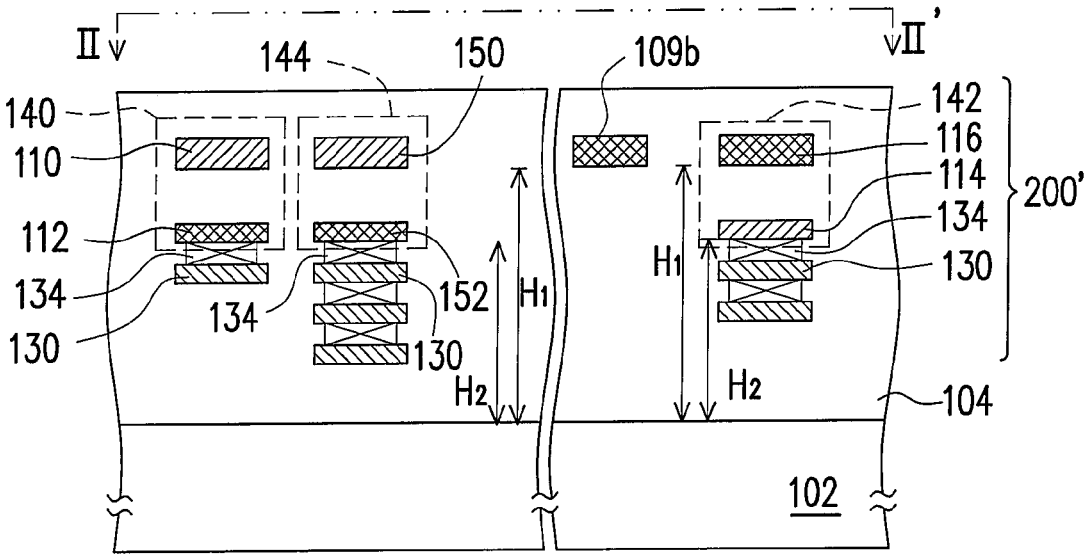
FIG. 2C is a cross-sectional diagram taken across II-II' line in FIG. 2A according to another embodiment of the present invention.
Figure 2D:
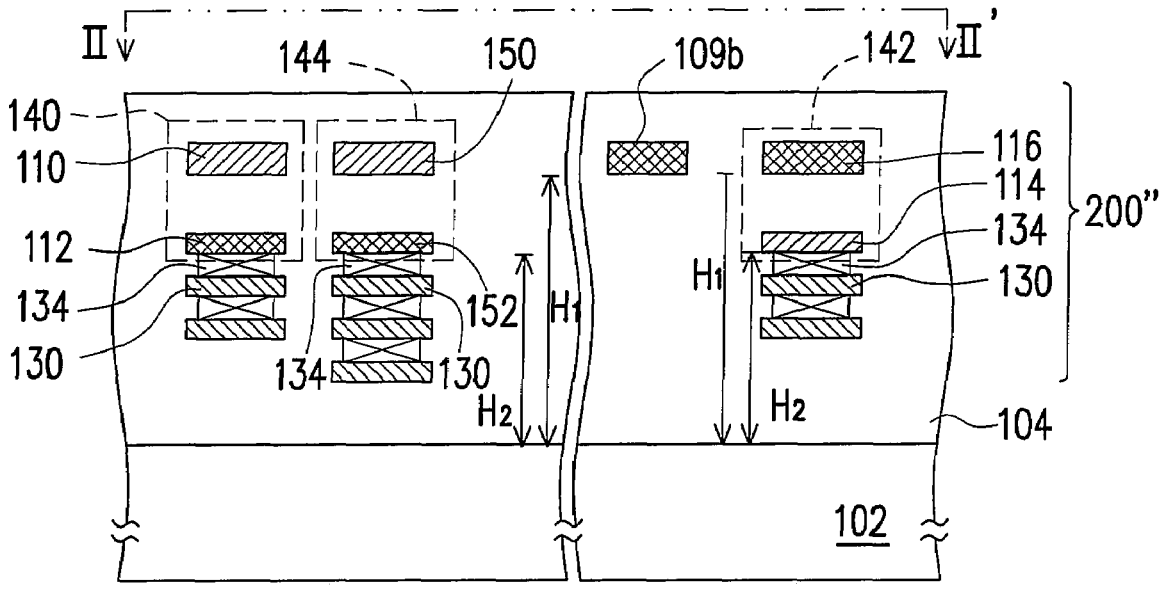
FIG. 2D is a cross-sectional diagram taken across II-II' line in FIG. 2A according to yet another embodiment of the present invention.

FIG. 2A is a top view diagram of an inductor structure according to yet another embodiment of the present invention, FIG. 2B is a cross-sectional diagram taken across II-II' line in FIG. 2A, FIG. 2C is a cross-sectional diagram taken across II-II' line in FIG. 2A according to another embodiment of the present invention and FIG. 2D is a cross-sectional diagram taken across II-II' line in FIG. 2A according to yet another embodiment of the present invention. Note that the same components in FIGS. 2A-2D have the same notations as FIGS. 1A-1C.

The present invention also provides another inductor structure. Referring to FIGS. 2A and 2B, the inductor structure 200 is composed of the same components as the inductor structure 100, except that in the inductor structure 200, the spiral coils 106 and 108 are symmetrically disposed about a plane of symmetry 120 and twisted to form a spiral coil structure with 2N turns and having 2N−1 interlaced zones (N is a positive integral). The endpoint 107*b* of the spiral coil 106 and the endpoint 109*b* of the spiral coil 108 are intersected and connected to each other at the $2N^{th}$ turn of the inductor structure 200. Besides, the gain pattern 130 is disposed under at least the first connection lead at the $(2N-1)^{th}$ interlaced zone counted from the most-outer turn up (i.e., under the lowest connection lead within the interlaced zone at the most-inner turn) and electrically connected to the corresponding first connection lead so as to increase the cross-section area of the conductor of the inductor structure 200 and to lower conductor loss. The gain pattern 130 may also be disposed at least one of the interlaced zones from the first one to the $(2N-2)^{th}$ one and coupled with the lowest connection lead within the above-mentioned interlaced zone.

In the following, the inductor structure 200 with four turns and having three interlaced zones (i.e., N=2) is further exemplarily explained.

Referring to FIGS. 2A and 2B, a spiral coil 106 is, for example, composed of second conducting wires 106*a*, 106*b*, 106*c* and 106*d* and second connection leads 110, 114 and 150, wherein the second conducting wires 106*a*, 106*c*, 106*b* and 106*d* are connected in series to each other by the second connection leads 110, 114 and 150. A spiral coil 108 is, for example, composed of first conducting wires 108*a*, 108*b*, 108*c* and 108*d* and first connection leads 112, 116 and 152, wherein the first conducting wires 108*a*, 108*c*, 108*b* and 108*d* are connected in series to each other by the first connection leads 112, 116 and 152.

The second connection leads 110 and 150 and the first connection lead 116 are spaced from the surface of the substrate 102 by a height $H_1$, while the second connection lead 114 and the first connection leads 112 and 152 are spaced from the surface of the substrate 102 by a height $H_2$, wherein the height $H_1$ is greater that the height $H_2$. Thus, the interlaced zone 144 of the second connection lead 150 and the first connection lead 152 is, for example, located on the plane of symmetry 120. At the interlaced zone 144, the second conducting wires 106*b* and 106*d* are connected to each other through, for example, the second connection lead 150 located at the height $H_1$. As to the wiring relationship between the first conducting wires 108*b* and 108*d*, the first conducting wire 108*b* is connected to the first connection lead 152 located at the height $H_2$ through, for example, a via plug 126*a*, and then the first connection lead 152 is connected to the first conducting wire 108*d* through a via plug 126*b*.

Continuing to FIGS. 2A and 2B, the gain pattern 130 is disposed, for example, under the first connection lead 152 at the third interlaced zone (the interlaced zone 144) counted from the most-outer turn up. In the embodiment, the gain pattern 130 having two layers is disposed under the first connection lead 152. The gain pattern 130 is coupled with the first connection lead 152 through, for example, two or more via plugs 134. When the gain pattern 130 has a plurality of layers, any two adjacent gain patterns 130 are in parallel connection by means of a plurality of via plugs 134.

Referring to FIG. 2C, in an inductor structure 200', except for being disposed under the first connection lead 152, the gain pattern 130 may be also disposed under the first connection lead 112 at the first interlaced zone (the interlaced zone 140) counted from the most-outer turn up and under the second connection lead 114 at the second interlaced zone (the interlaced zone 142). In the embodiment, the first connection lead 112, the second connection lead 114 and the first connection lead 152 are in parallel connection to the gain pattern 130 by means of a plurality of via plugs 134.

In the inductor structure 200', the layer numbers of the three gain patterns 130 respectively disposed at the interlaced zones 140, 142 and 144 are, for example, gradually descending from the most-inner turn to the most-outer turn. In more detail, the stack number of the gain pattern 130 under the first connection lead 112 disposed at the interlaced zone 140 is one, the stack number of the gain pattern 130 under the second connection lead 114 disposed at the interlaced zone 142 is two and the stack number of the gain pattern 130 under the first connection lead 152 disposed at the interlaced zone 144 is three.

On the other hand, the gain patterns 130 respectively disposed at the interlaced zones 140, 142 and 144 allow having other disposing manners. Referring to FIG. 2D, the inductor structure 200" and the inductor structure 200' has almost same components, except that the stack numbers of the gain patterns 130 are different. In the inductor structure 200", the two gain patterns 130 disposed at the interlaced zones 140 and 142 may have a same stack number, while the gain pattern 130 disposed at the interlaced zone 144 has a stack number greater than the stack numbers of the gain patterns 130 at the interlaced zones 140 and 142. In the embodiment, the stack number of the gain pattern 130 under the first connection lead 112 is two, the stack number of the gain pattern 130 under the second connection lead 114 is two and the stack number of the gain pattern 130 under the first connection lead 152 is three.

Therefore, when N=2, the inductor structure is a spiral coil structure with four turns and having three interlaced zones. In an embodiment, the gain pattern is, for example, disposed only under the connection lead at the third interlaced zone. In another embodiment, except for being disposed under the connection lead at the third interlaced zone, the gain pattern is also disposed under the connection lead at one of the first and the second interlaced zones, wherein the stack layer number of the gain pattern disposed at the third interlaced zone is greater than the stack layer number of the gain pattern at one of the first and the second interlaced zones. In yet another embodiment, a gain pattern is disposed at the connection lead at every interlaced zone, the stack layer number at the third interlaced zone is the most among all the gain patterns and the stack layer numbers of the gain patterns at other interlaced zones (the first and the second interlaced zones) are, for example, the same or gradually descending from the most-inner turn to the most-outer turn.

Note that when operation voltages are simultaneously applied at the endpoints 107*a* and 109*a* of the inductor structures 200, 200' and 200", i.e., the above-mentioned inductor structures are used in a symmetric differential inductor, since a gain pattern 130 is disposed under at least the first connection lead 152 with a larger current density, thus, the cross-section area of the conductor may be effectively increased so as to improve conductor loss and advance inductor quality. Besides, as shown by FIG. 2C, if the number of the deployed gain patterns 130 are descending from the most-inner turn (the interlaced zone 144) to the most-outer turn (the interlaced zone 140), except for increasing cross-section area of the conductor, more symmetric responses produced by the spiral coils 106 and 108 are obtained, which further advances the Q-factor of the inductor.

Certainly, the twist manner between the spiral coils 106 and 108, the turn number of the spiral coil structure thereof, and the disposing manner and the stack numbers of the gain patterns 130 are not limited to by the above-described embodiments. The critical requirement needs to be met is that the gain pattern 130 is at least disposed under the lowest connection lead within the interlaced zone at the most-inner turn. Anyone skilled in the art is able to modify the disposing manner depending on the practical demand.

Figure 3:
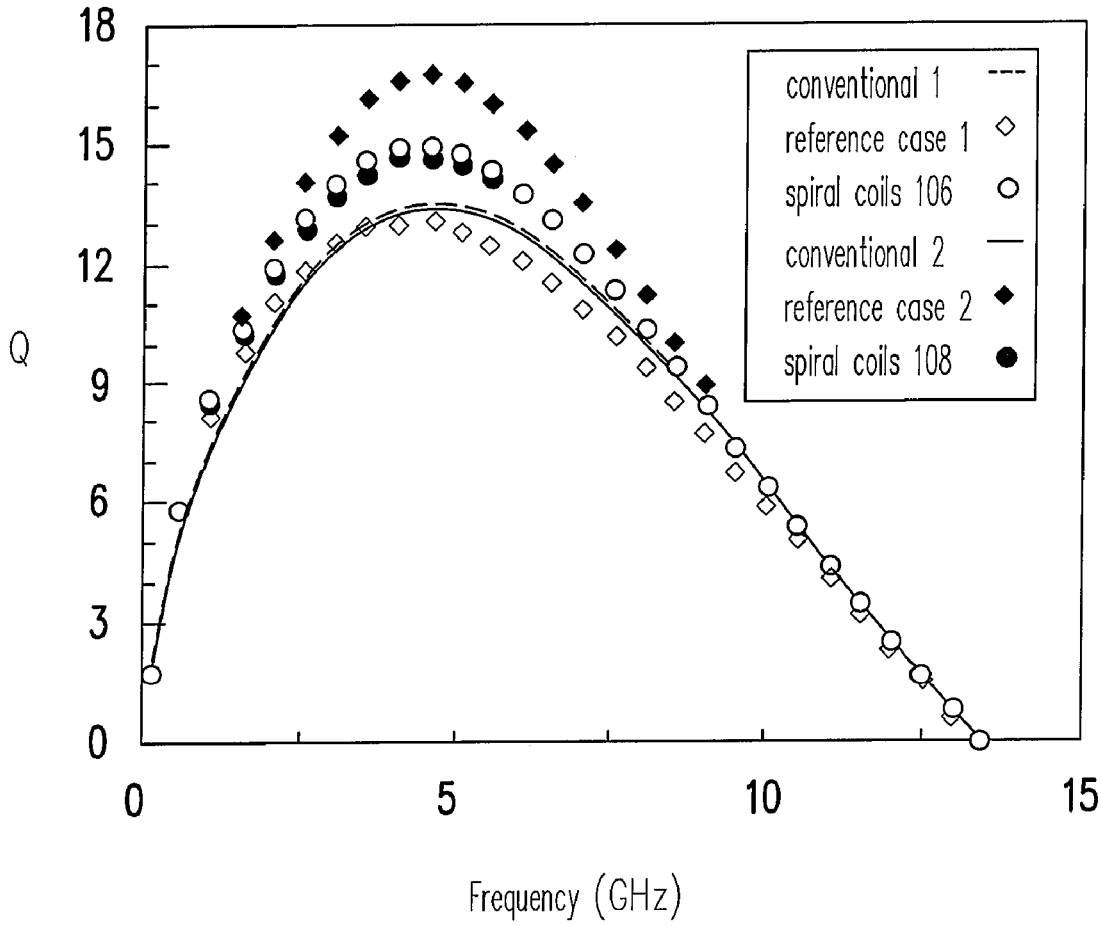
FIG. 3 is a graph showing the Q-factors of two spiral coils respectively corresponding to a conventional inductor structure and an inductor structure of the present invention wherein the inductor structures are used in a symmetric differential inductor.

FIG. 3 is a graph showing the Q-factors of three sets of two spiral coils respectively corresponding to the inductor structure 100 of an embodiment of the present invention, an inductor structure serving as a reference case and a conventional inductor structure, wherein the inductor structures are used in a symmetric differential inductor. The inductor structure of the above-mentioned reference case is similar to the inductor structure of the present invention except that in the reference case, the stack number of the gain pattern disposed under the inner interlaced zone of the inductor structure is less than the stack number of the gain pattern disposed under the outer interlaced zone of the inductor structure. For example, the stack number of the gain pattern 130 disposed under the interlaced zone 140 in FIG. 1C is changed to three and the stack number of the gain pattern 130 disposed under the interlaced zone 142 is changed to two. In addition, in FIG. 3, 'conventional 1' represents a spiral coil composing the conventional inductor structure and 'conventional 2' represents another spiral coil composing the conventional inductor structure; 'reference case 1' represents a spiral coil composing the inductor structure of the reference case and 'reference case 2' represents another spiral coil composing the inductor structure of the reference case.

Referring to FIG. 3, it can be seen from the practical testing results, the spiral coils 106 and 108 in the inductor structure 100 of the above-described embodiment have higher Q-factors than that of the 'conventional 1' and 'conventional 2'. Note that within the frequency range from 0 GHz to 15 GHz, the inductor structure of the 'reference case 2' has higher Q-factors than that of the spiral coils 106 and 108. However, the distributions of Q-factors for the 'reference case 1' is in overall view not conformed to that of the 'reference case 2', which causes unsymmetrical responses for each spiral coil of the inductor structure in the reference case. On the other hand, the distributions of Q-factors for both the spiral coils 106 and 108 of the present invention are almost conformed to each other. Therefore, the inductor structure of the present invention obviously advances the inductor quality and enables both the spiral coils 106 and 108 to produce more symmetric responses.

In summary, in the inductor structure provided by the present invention, at least a gain pattern is disposed under an interlaced zone and the stacked gain pattern is coupled with a corresponding connection lead; therefore, the inductor structure of the present invention is able to reduce conductor loss occurred at the inner interlaced zone of the inductor structure by increasing the cross-section area of the metal and accordingly advance the Q-factor of the inductor.

Furthermore, since the number of the gain patterns disposed at the outer interlaced zone of the inductor structure where a larger electric field is presented is less than that at the inner interlaced zone, the two couplings between each of the two spiral coils and the substrate are similar to each other; therefore, when the inductor structure of the present invention is used in a symmetric differential inductor, both the spiral coils are able to produce more symmetric responses, which further advances the inductor efficiency.

Moreover, the applicable frequency range of the inductor structure provided by the present invention can keep within the frequency range required by an RF circuit. The inductor structure of the present invention can be incorporated into the currently practical process, which is helpful to lower the process cost.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An inductor structure, disposed over a substrate; the inductor structure comprising:

a first spiral coil, having a first end and a second end, wherein the second end rotates in spiral fashion towards the inner portion of the first spiral coil and the first spiral coil comprises:

a plurality of first conducting wires; and a first connection lead, connecting two adjacent first conducting wires;

a second spiral coil, symmetrically to the first spiral coil disposed about a plane of symmetry and having a third end and a fourth end, wherein the fourth end rotates in spiral fashion towards the inner portion of the second spiral coil and connected to the second end of the first spiral coil to form a spiral coil structure with 2N turns, wherein N is a positive integral, and the second spiral coil comprises:

a plurality of second conducting wires; and a second connection lead, connecting two adjacent second conducting wires, wherein the first connection lead and the second connection lead are interlaced with each other on the plane of symmetry and spaced from the substrate by different heights to form 2N−1 interlaced zones; and at least a gain pattern, disposed under the first connection lead at the $(2N-1)^{th}$ interlaced zone counted from the most-outer turn up and electrically connected to the corresponding first connection lead.

2. The inductor structure according to claim 1, wherein when the interlaced zone is the $odd^{th}$ interlaced zone, the first connection lead is underlying the second connection lead.

3. The inductor structure according to claim 1, wherein when the interlaced zone is the $even^{th}$ interlaced zone, the second connection lead is underlying the first connection lead.

4. The inductor structure according to claim 1, further comprising that the gain pattern is disposed at least one of the interlaced zones from the first one to the $(2N-2)^{th}$ one and underlying the lowest connection lead within the interlaced zone.

5. The inductor structure according to claim 4, wherein the disposing quantity of the gain pattern at the $(2N-1)^{th}$ interlaced zone is greater than that at other interlaced zones.

6. The inductor structure according to claim 1, further comprising that the gain pattern is disposed underlying the lowest connection lead within every interlaced zone.

7. The inductor structure according to claim 6, wherein the disposing quantity of the gain pattern at the $(2N-1)^{th}$ interlaced zone is greater than that at other interlaced zones.

8. The inductor structure according to claim 7, wherein the disposing quantities of the gain patterns at other interlaced zones are the same.

9. The inductor structure according to claim 7, wherein the disposing quantity of the gain pattern at each interlaced zone is gradually descending from the inner turn to the outer turn.

10. An inductor structure, disposed over a substrate; the inductor structure comprising:

a first spiral coil, having a first end and a second end, wherein the second end rotates in spiral fashion towards the inner portion of the first spiral coil and the first spiral coil comprises:

a plurality of first conducting wires; and a first connection lead, connecting two adjacent first conducting wires;

a second spiral coil, symmetrically to the first spiral coil disposed about a plane of symmetry and having a third end and a fourth end, wherein the fourth end rotates in spiral fashion towards the inner portion of the second spiral coil and connected to the second end of the first spiral coil to form a spiral coil structure with 2N+1 turns, wherein N is a positive integral, and the second spiral coil comprises:

a plurality of second conducting wires; and a second connection lead, connecting two adjacent second conducting wires, wherein the first connection lead and the second connection lead are interlaced with each other on the plane of symmetry and spaced from the substrate by different heights to form 2N interlaced zones; and at least a gain pattern, disposed under the second connection lead at the $2N^{th}$ interlaced zone counted from the most-outer turn up and electrically connected to the corresponding second connection lead.

11. The inductor structure according to claim 10, wherein when the interlaced zone is the $odd^{th}$ interlaced zone, the first connection lead is underlying the second connection lead.

12. The inductor structure according to claim 10, wherein when the interlaced zone is the $even^{th}$ interlaced zone, the second connection lead is underlying the first connection lead.

13. The inductor structure according to claim 10, further comprising that the gain pattern is disposed at least one of the interlaced zones from the first one to the $(2N-1)^{th}$ one and underlying the lowest connection lead within the interlaced zone.

14. The inductor structure according to claim 13, wherein the disposing quantity of the gain pattern at the $2N^{th}$ interlaced zone is greater than that at other interlaced zones.

15. The inductor structure according to claim 10, further comprising that the gain pattern is disposed underlying the lowest connection lead within every interlaced zone.

16. The inductor structure according to claim 15, wherein the disposing quantity of the gain pattern at the $2N^{th}$ interlaced zone is greater than that at other interlaced zones.

17. The inductor structure according to claim 16, wherein the disposing quantities of the gain patterns at other interlaced zones are the same.

18. The inductor structure according to claim 16, wherein the disposing quantity of the gain pattern at each interlaced zone is gradually descending from the inner turn to the outer turn.

* * * * *